United States Patent [19]

Michelson et al.

[11] Patent Number: 4,629,413

[45] Date of Patent: Dec. 16, 1986

[54] LOW $NO_x$ PREMIX BURNER

[75] Inventors: Herbert D. Michelson, Fort Lee; James P. Stumbar, Berkeley Heights, both of N.J.

[73] Assignee: Exxon Research & Engineering Co., Florham Park, N.J.

[21] Appl. No.: 648,494

[22] Filed: Sep. 10, 1984

[51] Int. Cl.[4] ..... F23M 3/00

[52] U.S. Cl. ..... 431/9; 431/10; 431/116; 431/188; 431/284

[58] Field of Search ..... 431/9, 10, 116, 166, 431/181, 187, 188, 190, 174, 284, 351; 432/159; 110/260

[56] References Cited

U.S. PATENT DOCUMENTS

| | | | |
|---|---|---|---|
| 2,011,283 | 8/1935 | Huff | 431/190 |
| 2,333,531 | 11/1943 | Ferguson | 431/166 |
| 2,592,911 | 4/1952 | Ketelsen | 431/181 |
| 2,918,117 | 12/1959 | Griffin | 431/188 |
| 3,267,984 | 8/1966 | Reed et al. | 158/1.5 |
| 3,663,153 | 5/1972 | Bagge et al. | 431/351 |
| 3,684,189 | 8/1972 | Reed et al. | 239/425.5 |
| 3,684,424 | 8/1972 | Zink et al. | 341/114 |
| 3,918,834 | 11/1975 | Sigal et al. | 431/10 |
| 3,940,234 | 2/1976 | Reed et al. | 431/348 |
| 4,004,875 | 1/1977 | Zink et al. | 431/9 |
| 4,082,497 | 4/1978 | Crawford | 431/158 |
| 4,157,890 | 6/1979 | Reed | 431/187 |
| 4,257,763 | 3/1981 | Reed | 431/188 |
| 4,281,983 | 8/1981 | Goodnight et al. | 431/188 X |
| 4,289,474 | 9/1981 | Honda et al. | 431/10 |
| 4,351,632 | 9/1982 | Nagai | 431/183 |
| 4,439,137 | 3/1984 | Suzuki et al. | 431/8 |
| 4,445,842 | 5/1984 | Syska | 431/187 |
| 4,488,869 | 12/1984 | Voorheis | 431/351 X |
| 4,496,306 | 1/1985 | Okigami et al. | 431/174 X |
| 4,505,666 | 3/1985 | Martin et al. | 431/175 X |

FOREIGN PATENT DOCUMENTS

| | | | |
|---|---|---|---|
| 586099 | 10/1933 | Fed. Rep. of Germany | 431/181 |
| 0126527 | 11/1978 | Japan | 431/181 |
| 0054340 | 4/1979 | Japan | 431/181 |
| 0092814 | 7/1980 | Japan | 431/187 |

*Primary Examiner*—Margaret A. Focarino
*Attorney, Agent, or Firm*—R. Yablonsky

[57] ABSTRACT

The invention relates to an improved premix burner and a method of its operation for combustion with a minimum of $NO_x$ emissions. The improvement is achieved by combining staged combustion with a premix burner in a manner such that mixing of the secondary air with the flame is delayed.

17 Claims, 8 Drawing Figures

FIG. 2a
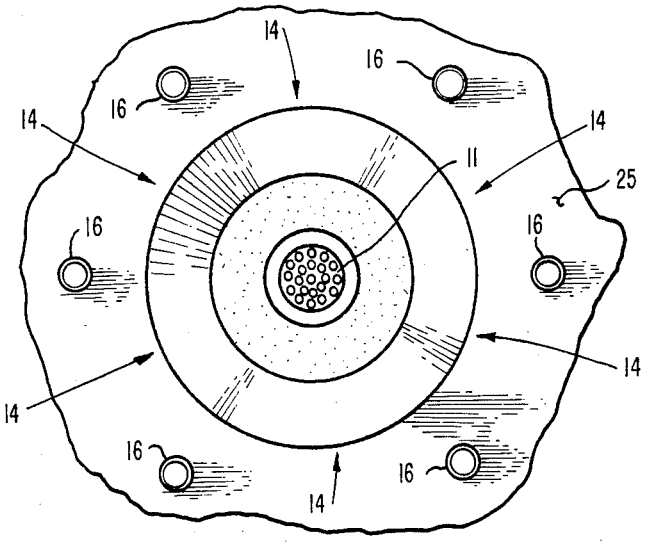
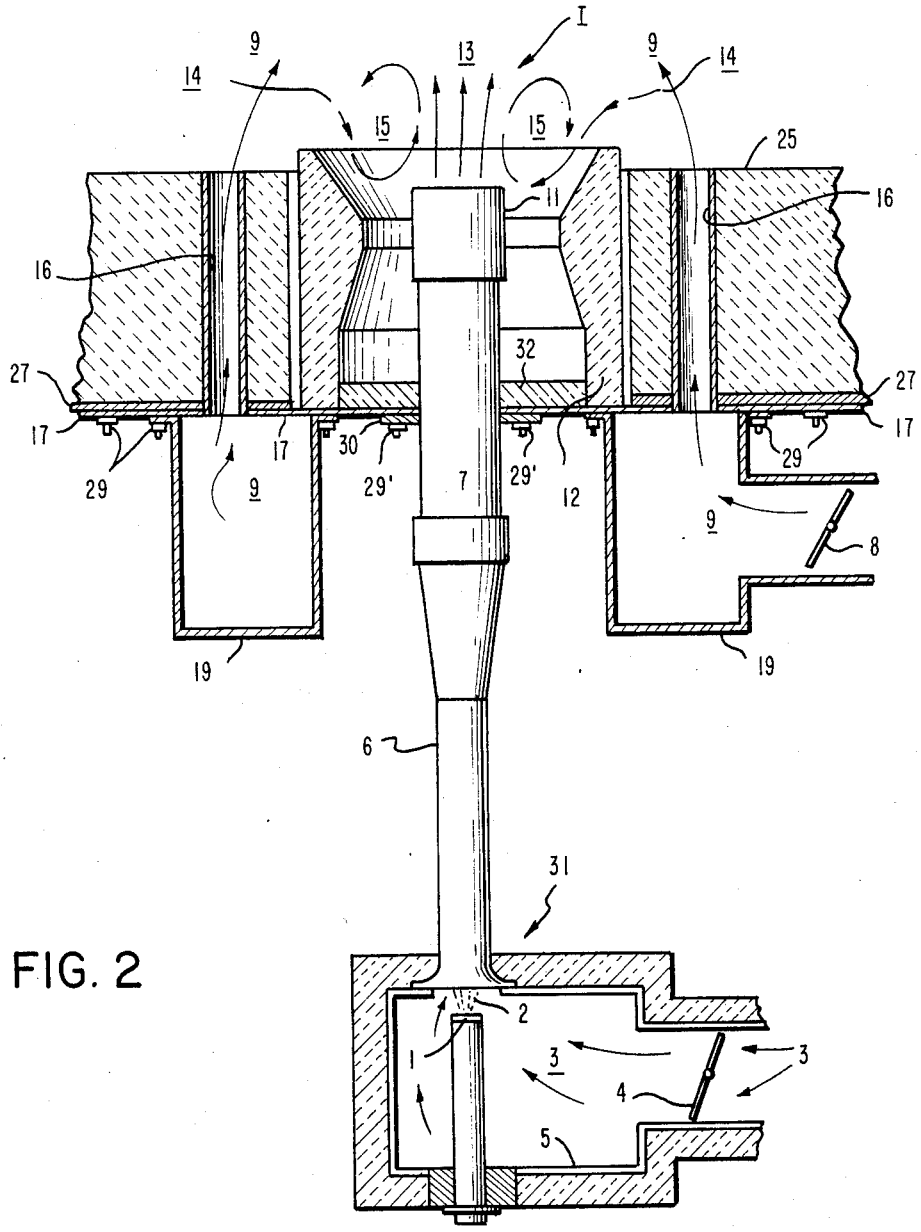
FIG. 2

LOW $NO_x$ PM BURNER PERFORMANCE
- EFFECT OF AIR INSPIRATION
ON $NO_x$ EMISSIONS

DATA BASIS

AMBIENT DRY AIR
QF = 4.4 MBTU/h
$O_2$ = 3.5 VOL. %

WALL REFRACTORY TEMPERATURE PROFILE

DATA BASIS

QF = 4.4 MBTU/h $O_2$ = 3.5 VOL.%

50% THEORETICAL AIR INSPIRATED BY PM BURNERS

DRY AMBIENT AIR

LOW $NO_x$ PREMIX BURNER

FIELD OF THE INVENTION

This invention relates to an improvement in a premix (PM) burner such as employed in high temperature furnaces, for example for steam cracking hydrocarbons. More particularly, it relates to the combining of staged combustion with a premix burner in a novel configuration to achieve a reduction in $NO_x$ emissions.

The term $NO_x$ refers to various nitrogen oxides that may be formed in air at high temperatures. Reduction of $NO_x$ emissions is a desired goal in order to decrease air pollution which is subject to governmental regulations.

Gas fired burners are classified as either premix or raw gas depending on the method used to combine the air and fuel. They also differ in configuration and the type of burner tip used.

Raw gas burners inject fuel directly into the air stream, and the mixing of fuel and air occurs simultaneously with combustion. Since air flow does not change appreciably with fuel flow, the air register settings of natural draft burners usually must be changed after firing rate changes. Therefore, frequent adjustment may be necessary—see the discussion in U.S. Pat. No. 4,257,763. Also, many raw gas burners produce luminous flames.

Premix burners mix the fuel with some or all of the combustion air prior to combustion. Since premixing is accomplished by using the energy of the fuel stream, air flow is largely proportional to fuel flow. Therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers mainly because of their ability to produce a relatively uniform heat distribution profile in the tall radiant sections of these furnaces. Flames are non-luminous, permitting tube metal temperatures to be readily monitored. Therefore, a premix burner is the candidate of choice for such furnaces. Premix burners can also be designed for special heat distribution profiles or flame shapes required in other types of furnaces.

For these reasons raw gas burners are outside the scope of this invention although they will be referred to for purposes of comparison.

In the context of premix burners, the term primary air refers to the air premixed with the fuel; secondary and in some cases tertiary, air refers to the balance. In raw gas burners, primary air is the air that is closely associated with the fuel; secondary and tertiary air are more remotely associated with the fuel. The upper limit of flammability refers to the mixture containing the maximum fuel concentration (fuel-rich) through which a flame can propagate.

BACKGROUND OF THE INVENTION

U.S. Pat. No. 4,157,890 concerns a wall burner and the object is to reduce $NO_x$ by introducing combustion products into the combustion zone by aerodynamic means instead of by using cumbersome equipment to recirculate furnace flue gas from the stack back to the burner. This is done by means of staging of fuel, not staging of air, that is by the use of a preliminary or secondary burner upstream of the primary burner, in which a small fraction of the total gaseous fuel is burned in the midst of the flow of secondary air, so that the products of complete combustion of a fraction of the gases are carried by the secondary air downstreamwardly into the combustion zone of the primary burner. It may be noted that the secondary air passes through the space between the wall and the burner tube, surrounding it and passing in proximity to all the burners so that this air is provided at the place where the primary burning is initiated.

U.S. Pat. No. 3,684,189 shows conventional means for inspiration of primary air in a premix burner, generically termed a jet eductor. In this arrangement, at the upstream end of the burner tube, high pressure fuel gas contained in a pipe flows through an orifice into the entry section of a venturi, for inspirating primary air into the opening therebetween to mix with the fuel gas. U.S. Pat. Nos. 3,684,424 and 3,940,234 show a typical configuration in which a ceramic member or tile surrounds the distal or downstream end section of the burner tube and secondary air flows through a passageway between the tile and the tube.

U.S. Pat. No. 3,267,984 discloses a raw gas burner the object of which is to have the burning fuel move along an annular surface of a ceramic structure. The burner tip is provided with discharge apertures for liquid fuel as droplets and also with discharge ports for gaseous fuel. Air at relatively high pressure is supplied and flows in two paths. The major portion of the air is introduced downstream of the tip in a manner to set up a spinning mass of air into which the liquid fuel droplets are drawn by the low pressure developed in the whirling air. A minor portion of the air mixes with the gaseous fuel. This mixture provides a stable flame and the burning gaseous fuel moves downstream into the whirling air mass.

The patents discussed are incorporated herein by reference.

In U.S. Pat. No. 4,004,875 a burner for lowering $NO_x$ is disclosed which has staged secondary air, but is not a premix burner and requires recirculation of a portion of the combustion products resulting from the burning of the fuel with primary air. It also suggests that tertiary air can also be used.

U.S. Pat. No. 4,257,763 relates to U.S. Pat. No. 4,004,875 and provides a control mechanism for fixing the ratio of primary-secondary air/tertiary air. However, this does not make total air flow change with fuel flow. The patent also employs water atomization to the first burning zone.

Other patents of general interest are: U.S. Pat. Nos. 3,663,153; 3,918,834; 4,082,497; 4,439,137; and 4,289,474.

SUMMARY OF THE INVENTION

The low $NO_x$ PM burner of this invention differs from the standard PM burner commercially available by provisions to delay the mixing of secondary air with the flame and allow cooled flue gas to recirculate. This delayed mixing results in greater relative heat loss, lower flame temperatures and lower $NO_x$ production. With this approach it has been found that within a critical range of primary air percentage of stoichiometric, which closely approaches the fuel-rich, upper limit of flammability and is selected from the range of about 25% to about 65% of stoichiometric depending on the particular fuel chosen, the production of $NO_x$ is surprisingly reduced as compared with the standard PM burner and the best of the commercially available raw gas burners.

It has been found that the PM burner is uniquely adapted for combining with staging of air to give lower $NO_x$ production than raw gas burners because of the excellent control of primary air percentage of stoichiometric afforded by fuel gas jets pulling in a steady, regular proportion of air in the premixing. On the other hand, this kind of cooperation does not exist in raw gas burners. Thus, the invention makes use of combining a jet eductor to inspirate primary air in a critical amount, with staging of secondary air.

According to the invention, an improved premix burner is provided having means whereby secondary air is supplied in a manner that promotes mixing of this air with the flame downstream of the zone of burning of the primary air with the fuel, viz., so that the combustion reactions are completed within the furnace enclosure. In addition, the improved burner promotes recirculation of flue gas into the initial flame zone as well as the flame downstream of primary air/fuel.

In the standard PM burner a burner tile having a central opening in which a burner tube is accommodated, is arranged surrounding and radially spaced from the distal end portion of the burner tube, viz., in the vicinity of the tip, and secondary air is passed downstreamwardly in the passageway between the tile and the tip, at which tip the flame is generated by the primary air/fuel mixture. On the contrary, in the preferred burner configuration of this invention, the secondary air is blocked off by a sealing plate from the passageway between the tile and the tip and instead is passed downstreamwardly outside the tile. That is to say, this secondary air is introduced into open tubes or simply openings located far away from the burner, and then combustion is completed. By means of this separation, this air to a substantial extent mixes with the flame downstream of the burner to achieve delayed combustion and reduced $NO_x$.

Specifically, the secondary air system is revised by blocking the original flow path through the burner tile with an insulated plate and adding several, e.g., six new secondary air ports outside of the tile, as well as a new secondary air register. This stages the combustion by delaying the mixing of secondary air with the flame, promotes mixing of flue gas with secondary air and it also increases the amount of flue gas entrained or recirculated into the base of the flame. The result is a lower flame temperature and reduced $NO_x$ production.

In another embodiment, a small quantity of the secondary air, in this connection called a slipstream of air, is allowed to flow through the passageway between the tile and the tip; however, most of the secondary air is passed outside the tile just as in the preferred embodiment.

In more detail, a premix burner having a burner tube is provided with a jet eductor system at the upstream end section of the tube for inspirating and mixing primary air with fuel gas, a burner tip at the downstream end of the tube provided with ports for receiving and burning the mixture of primary air and fuel gas, and a burner tile surrounding and radially spaced from the downstream end section of the tube. The improvement comprises means for sealing off the channel between the tile and said tube section to prevent access of secondary air thereto, and means for supplying secondary air to flow downstreamwardly outside of the tile and to promote mixing of the secondary air with the flame downstream of the burner to achieve delayed combustion.

BRIEF DESCRIPTION OF THE DRAWINGS

The invention is illustrated by the accompanying drawings wherein like numbers indicate like parts, in which:

FIG. 2 shows an elevation partly in section of the preferred configuration of a low $NO_x$ premix burner of this invention;

FIG. 2A shows a top plan view of the burner of FIG. 2;

FIGS. 4–7 are graphs comparing the low $NO_x$ PM burner of this invention with the standard PM burner and a commercial raw gas burner, in which:

FIG. 4 is a plot of $NO_x$ emissions versus air temperature;

FIG. 5 is a plot of $NO_x$ emissions versus percent of excess oxygen;

FIG. 6 is a plot of $NO_x$ emissions versus percent of theoretical air inspirated;

FIG. 7 is a wall refractory temperature profile.

In the graphs, QF means firing rate in million British Thermal Units per hour; VPPM means volume parts per million; at 4% $O_2$ means $NO_X$ concentrations are corrected to the equivalent concentration of a flue gas that contains 4% oxygen on a dry basis; #/MBTU means pounds of $NO_X$ emitted which is expressed as $NO_2$ per million British Thermal Units fired; length average temperature means the average temperature determined by dividing the temperature profile into ten or more equal length increments, adding the arithmetic average temperature in each increment and dividing by the number of increments.

DETAILED DESCRIPTION

Fuel and Air Delivery Equipment

Figure 1:
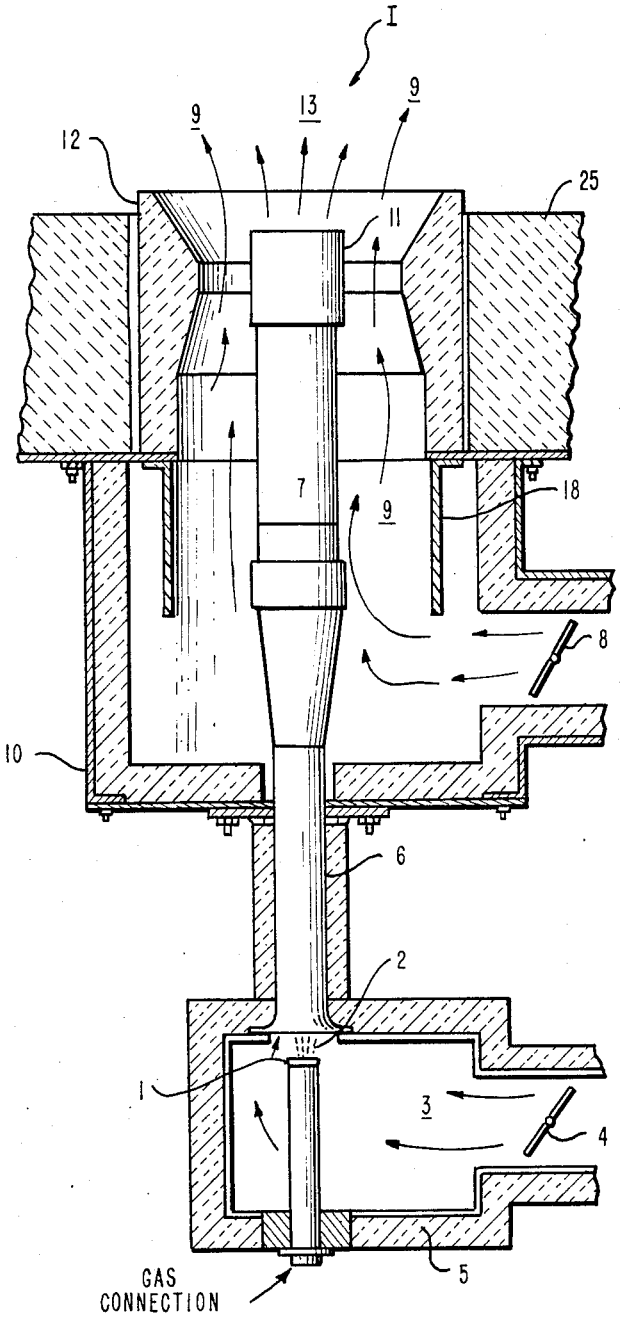
FIG. 1 PRIOR ART
FIG. 1 illustrates the prior art, the configuration being referred to herein as the standard premix burner.

A standard type of premix burner is shown in FIG. 1. It consists of equipment to supply and control fuel, primary air, and secondary air. The burner tube I is located within an annular tile 12 which is installed in a tile well in the refractory furnace floor 25. The tile may extend about 1 to 2 inches above the furnace floor.

(A) Fuel System—Single or multiple hole orifice spud 1, inside the primary air system, 1, 4, 5, 6, 7, 11. The spud meters the fuel to the burner and provides fuel jet(s) 2 to entrain primary air 3.

(B) Primary Air System—Orifice spud 1, venturi or mixer 6, extension tube 7 (optional), air control device 4 (optional), primary air plenum 5 (optional), and burner tip 11. This is the most important system. It entrains some or most of the air needed for combustion, provides a means of mixing this air with the fuel prior to combustion, provides a flame stabilizer and is paramount for determining the final flame characteristics.

(C) Secondary Air System—Air control device 8 (air register or damper) secondary air plenum 10 (optional), distribution baffle 18 (optional), and burner tile 12. This supplements the primary air system by supplying the balance of the air 9 required for combustion of the fuel. Since the mixing of the fuel and air is imperfect, excess air is required in addition to the stoichiometric requirements of the fuel to ensure complete combustion. Excess air greater than this quantity unnecessarily reduces furnace efficiency and increases $NO_X$ emissions. Therefore, the secondary air system must be capable of properly controlling the supply of excess air.

Primary Air System Operation

The primary air system uses the principle of a jet pump, or jet eductor, to entrain combustion air and mix it with the fuel. As shown in FIG. 1, fuel gas pressure is converted to kinetic energy in an orifice spud 1 which is drilled to produce one or more high velocity jets 2. These fuel jets entrain the primary air 3 into a venturi section 6 where the fuel and air are mixed. The damper 4 and primary air plenum 5 are commonly used for air preheat or forced draft operation. Otherwise a muffler is often used to decrease noise emissions.

Since the primary air system uses the momentum of the fuel jets 2 to entrain air, the primary air inspiration rate is relatively insensitive to changes in furnace draft; air flow increases in proportion with fuel flow. Consequently, after changes in firing rate, premix burners require less frequent adjustments to control excess air levels than do raw gas burners.

After the fuel and air are mixed in the venturi 6, the mixture in 7 exits through the burner tip 11 and is burned. Burning begins as soon as the mixture leaves the ports in the tip. The tip 11 stabilizes the flame 13, and the geometry of the tip largely determines the shape of the flame.

Secondary Air System Operation

As shown in FIG. 1, the secondary air 9 enters the burner through a control device 8 (damper or air register), passes through the burner in the direction of the arrows and enters the furnace through an annular space formed by the burner tile 12 and burner tip 11. It is apparent that secondary air can start to mix immediately with the burning fuel - primary air mixture. The secondary air plenum 10 and cylindrical distribution baffle 18 are commonly used for air preheat, gas turbine exhaust, or forced draft operation. An air register rather than a plenum is usually used for natural draft operation.

The amount of secondary air flowing through the burner is determined by the balance between the driving force, provided by pressure difference between the draft at the furnace floor 25 and the pressure available at the inlet to the burner, and the resistance to flow caused by the pressure drops across the control device 8 and the burner tile 12. Hence, the secondary air flow is largely independent of the primary air flow and is relatively constant.

Standard Premix Burner $NO_x$

In combustion processes $NO_x$ is formed through the oxidation of nitrogen originating as either molecular nitrogen in air or atomic nitrogen chemically bound in the fuel. The former is referred to as thermal $NO_x$ while the latter is called fuel $NO_x$.

The mechanism for thermal $NO_x$ formation was first described by Zeldovich as follows:

$$N_2 + O \rightleftharpoons NO + N \quad (1)$$

$$O_2 + N \rightleftharpoons NO + O \quad (2)$$

$NO_x$ production in a standard burner is governed mainly by the temperature, composition and excess quantity of oxidant. At a constant oxidant temperature and composition, position, $NO_x$ production is governed mainly by the amount of excess oxidant or excess air, that is, the amount of combustion air in excess of the stoichiometric amount to achieve 100% combustion of the fuel, with $NO_x$ production being decreased as excess air is decreased. Another influence on $NO_x$ production is how the total air or oxidant is split between primary and secondary. Lowest $NO_x$ is obtained with reduction of primary air.

The reduction in $NO_x$ production as primary air is decreased in a premix burner, occurs because of two factors.

(i) Peak flame temperature is reduced because it takes longer for the fuel to react completely with the air. This increased time for reaction permits greater heat loss and results in a cooler flame. Reductions in peak flame temperature decrease the production of thermal $NO_x$ which is governed by the Zeldovich mechanism. This mechanism predicts that local $NO_x$ production in a flame occurs according to the following rate equation:

$$\frac{d[NO]}{dt} = 2A \exp[-E_a/RT][N_2][O] \quad (3)$$

$\frac{d[NO]}{dt}$ = Rate of NO formation (g-mole/sec)
$A$ = Constant
$E_a$ = Activation energy about (70 kcal/g-mole)
$R$ = Universal Gas Constant (1.986 cal/g-mole °k.)
$T$ = Temperature (°K.)
$[N_2]$ = Concentration of nitrogen molecules
$[O]$ = Concentration of oxygen atoms (ii) Oxygen molecule and oxygen atom concentrations in the premix portion of the flame are reduced and carbon monoxide and hydrogen concentrations are increased. This also reduces production of thermal $NO_x$ as shown in equation (3). In addition to reducing thermal $NO_x$, $NO_x$ production caused by bound nitrogen compounds in the fuel is also reduced. Bound nitrogen is nitrogen which is bonded to an atom different from another nitrogen atom. $NO_x$ production caused by bound nitrogen compounds is not affected significantly by changes in flame temperature.

Low $NO_x$ Premix Burner $NO_x$ production in the present invention follows the principles discussed just above. However, owing to the configuration of the burner and its mode of operation, $NO_x$ production decreases very rapidly as primary air to fuel ratio is decreased. In fact, for constant oxidant temperature and composition, $NO_x$ production is governed mainly by the split between primary and secondary air or oxidant. Minimum $NO_x$ is obtained when the primary air and fuel mixture is close to the fuel-rich or upper flammability limit, viz., when the air is within a range of 10% of the air corresponding to the upper flammability limit. But this minimum is surprisingly much lower than the minimum $NO_x$ produced in the standard PM burner. Effective $NO_x$ reduction in the burner of this invention is obtained when primary air is between about 25 to 65% of the stoichiometric air requirements depending on the fuel chosen. When greater than 65% of the stoichiometric air requirements is inspirated as primary air, $NO_x$ production is equal to or greater than that of the standard burner.

The primary air system of the new burner does not differ from standard premix burners. Most premix burner primary air system geometries can be used, subject to the constraint that the components in the preferred system should be sized to control primary air-to-fuel ratio to close to the optimum for minimum $NO_x$. Alternatively, a damper may be used to accomplish the same purpose.

The invention departs from standard premix burners in the manner in which the remaining combustion air is handled. Standard premix burners introduce all of the remaining combustion air or oxidant as secondary air 9 through the open area between the tip 11 and burner tile 12. This secondary air 9 starts to mix with the burning primary air and fuel mixture almost immediately, thus flame temperature is kept relatively high and staging is only partially effective. The critical feature of this invention is that it achieves minimum $NO_x$ production by moving much or all of the secondary air away from the burning primary air/fuel mixture 13 while primary air is maintained at close to the upper flammability limit. The preferred method is to move all of the secondary air 9 away from the burning primary air/fuel mixture 13.

Preferred Embodiment

One way this may be accomplished is shown in FIGS. 2 and 2*a*.

The burner assembly may be supported as a series of pieces bolted to the casing plate 27 of the furnace floor 25. In the embodiment shown in FIG. 2, this is accomplished as follows: The sealing plate 17 is bolted to the casing plate 27 by means of nuts and bolts 29. The other assemblies consisting of the burner tile 12, an insulation plug 32, the primary air assembly 31 with a collar 30 attached to extension tube 7, and the annular secondary air plenum 19 are attached to the sealing plate 17 by means of nuts and bolts 29'. Thus the burner assembly is supported by the sealing plate 17 and the sealing plate 17 is bolted to the furnace floor through the casing plate 27 of the furnace floor. The burner assembly may also be welded to the casing plate 27 or be made as a single assembly which is attached to the casing plate 27 by means of bolts, welding or other suitable means.

The resulting burner illustrated in FIGS. 2 and 2*a* is as shown in FIG. 1 except that the original path for secondary air is blocked by an insulated plate 17 and the secondary air 9 enters the burner through an annular plenum 19 via a control device 8. Secondary air 9 is distributed passing in the direction of the arrows through a series of air ports 16, which are located equidistant from the center of the burner. The air ports 16 are essentially tubes or openings originating in the secondary air plenum 19, passing through the furnace floor 25 and opening into the furnace. Geometry of the air ports—including: the distance, shape, height above or below the burner tile 12, the angle of the port centerline in relation to the centerline of the burner and the number of ports—may be varied giving small differences in the total $NO_x$ production but not changing the general operating principle of the invention.

Secondary air ports have been used in low $NO_x$ raw gas burners. However, these burners do not premix the fuel and air prior to combustion. This new combination of premixing of fuel and air, with staging, is an improvement which produces the following benefits.

1. Secondary air ports are used in combination with a premixing device to effectively stage combustion. The premixing device provides excellent control of the primary air - fuel ratio which largely determines the combustion properties in the fuel-rich combustion zone of the burner. This optimum ratio is maintained over a wide range of operating conditions especially when the burner is used in natural draft service.

2. It permits entrainment of flue gases 14 directly into the fuel-rich combustion zone at the base of the flame as shown in FIGS. 2 and 2*a*. This provides more rapid cooling and dilution of the flame and results in decreased thermal and fuel $NO_x$ production.

3. The large mass of primary fuel and air emerging from the burner tip forms a large recirculation zone 15 at the base of the flame which helps to maintain flame stability.

4. The use of separate secondary ports 16 is preferred because they concentrate the secondary air or oxidant into a series of separate jets. These jets also entrain flue gas, diluting the oxygen concentration and they increase the effectiveness of staging by pushing the air or oxidant to a higher vertical level than a 360° annular slot will do before it mixes with the flame. The extra time before secondary air 9 contacts the main flame 13 allows greater heat loss from the flame, produces more effective entrainment of flue gas, and promotes the reaction of fuel nitrogen compounds such as $NH_3$ to molecular nitrogen rather than $NO_x$.

Alternative Embodiment

Figure 3:
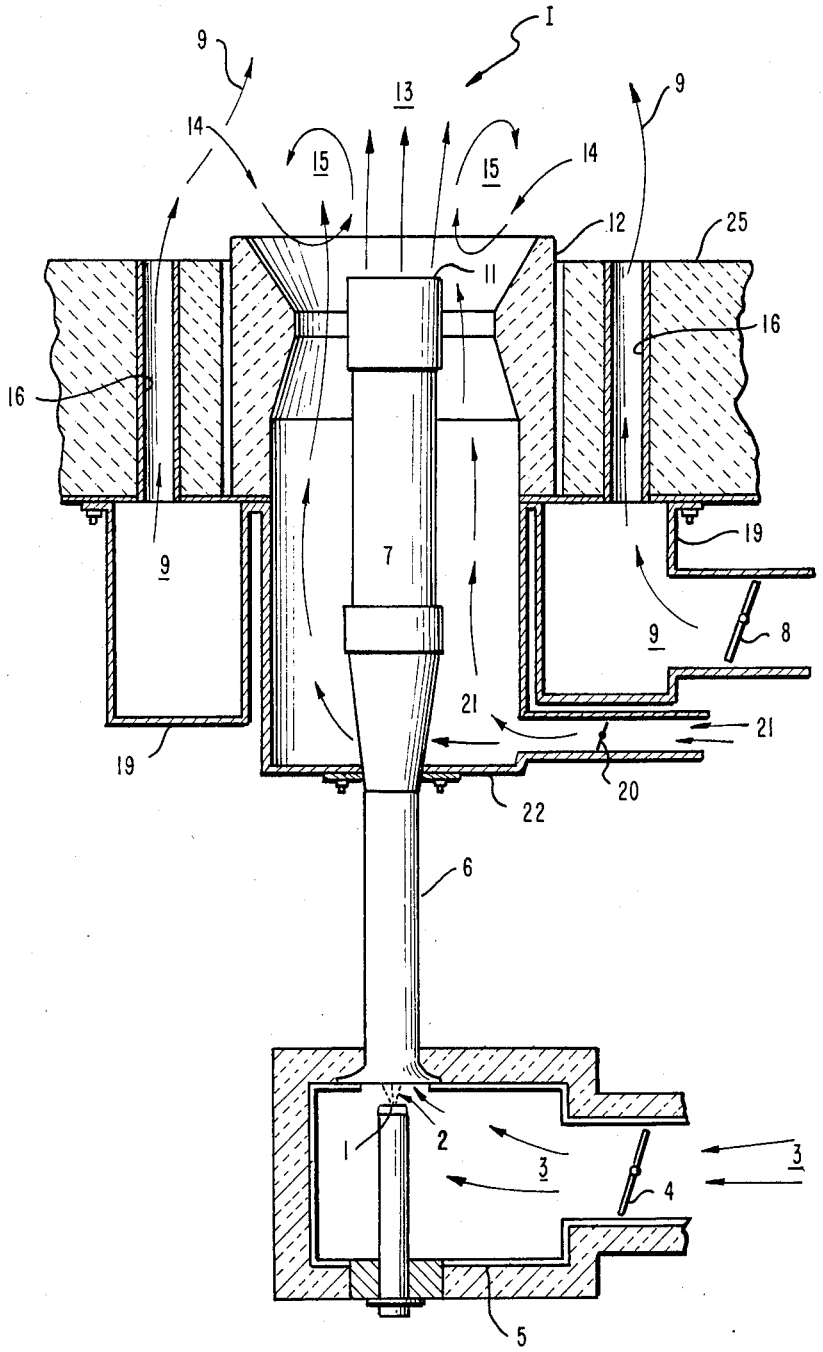
FIG. 3 shows a view as in FIG. 2 of an alternate configuration of a low $NO_x$ premix burner of this invention in which a slipstream of air is provided.

Another variation of the invention is shown in FIG. 3. This retains an air system 20, 22 adjacent to the primary air system. In this case, a small quantity of air or oxidant 21, which may be a slip-stream from the secondary air supply, comes through a damper 20 and air plenum 22 or through some other air control device. The remainder of the air goes through the primary air system and the air ports 16 as described in connection with the preferred embodiment. The staging now occurs in two steps with three air or oxidant supplies: Primary air 3, which is controlled to give a fuel/air mixture close to the upper flammability limit; a minor supply of air 21 which provides a small percentage of the stoichiometric requirements (less than 15%); and secondary air 9 which comes through the outer ports 16.

Although the burners of this invention have been described in connection with floor-fired pyrolysis furnaces, they may also be used on the side walls of such furnaces or in furnaces for carrying out other reactions or functions.

PM burners according to this invention may be used under a wide range of operating conditions as listed below:

| |
|---|
| firing rate - 1 to 10 MBTU/hr. |
| Fuel properties |
| hydrogen - up to 85 vol % |
| molecular weight - 5 to 50 |
| temperature - ambient to 900° F. |
| pressure - 2 to 35 psig |
| Oxidants |
| air |
| temperature - ambient |
| preheated from above ambient - 900° F. |
| Gas Turbine Exhaust |
| $O_2$ content - below 21 vol. % down to 14 vol. % |
| Temperature - 600 to 1050° F. |

The burner as illustrated in FIG. 2 was tested, always in the same test furnace, while simulating full scale furnace operation under the range of conditions listed in Table 1 and summarized as follows:

Fuel: Natural gas

Firing Rate: 4.4 MBTU/h—This was varied from 2.2 to 5.5 MBTU/h to check flame stability.

Air Temperature: Ambient to 650° F. (343° C.)

Excess $O_2$:3.5 vol%—This was tested from 1.5 to 5.2% with both ambient and 650° F. (343° C.) preheated air. Most data was taken at 3.5% $O_2$.

Primary Air Inspiration: 50% of theoretical (stoichiometric) air requirements—This was varied from 38 to 75% in the ambient air tests.

TABLE I

| TEST CONDITIONS | Typical Furnace Operating Conditions | Test Conditions: Design Point | Test Conditions: Variables tested in range given below Min. | Max. |
|---|---|---|---|---|
| Firing Rate (MBTU/h) | 4.4 | 4.4 | 2.2 | 5.5 |
| Excess $O_2$ (vol %) | 3.5 | 3.5 | 1.5 | 5.2 |
| Air Temp. | | | | |
| (°F.) | 50 | 50 | 20 | 650 |
| (°C.) | 10 | 10 | −7 | 343 |
| Primary Air Inspirated (% Theoretical) | 50 | 50 | 38 | 75 |
| Furnace Refractory Temperature | | | | |
| (°F.) | 2100 (length avg.) | 2100 | 1950 | 2250 |
| (°C.) | 1150 | 1150 | 1065 | 1230 |
| Fuel | Tail Gas | | Natural Gas | |
| Mol. Wt. | 16–22 | | 18 | |

It can be expected that $NO_x$ reduction performance in full scale furnaces will be comparable to that achieved in the test furnace, when operating under similar conditions such as:

Design firing rates—4–6 MBTU/h

Fuel type—similar to natural gas with a molecular weight ranging from 14 to 22.

Air temperatures—ambient to 700° F. (370° C.)

Figure 4:
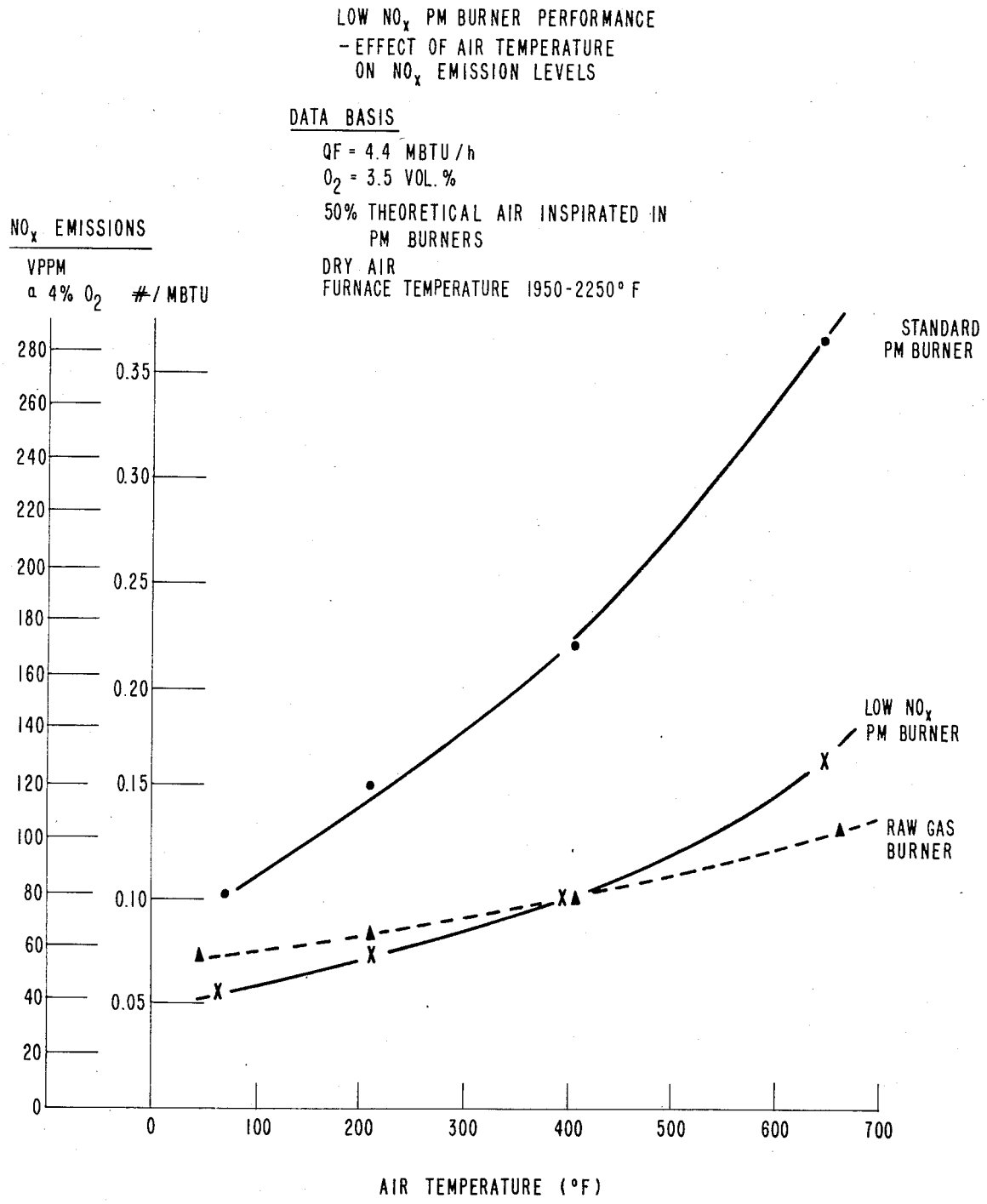
Figure 5:
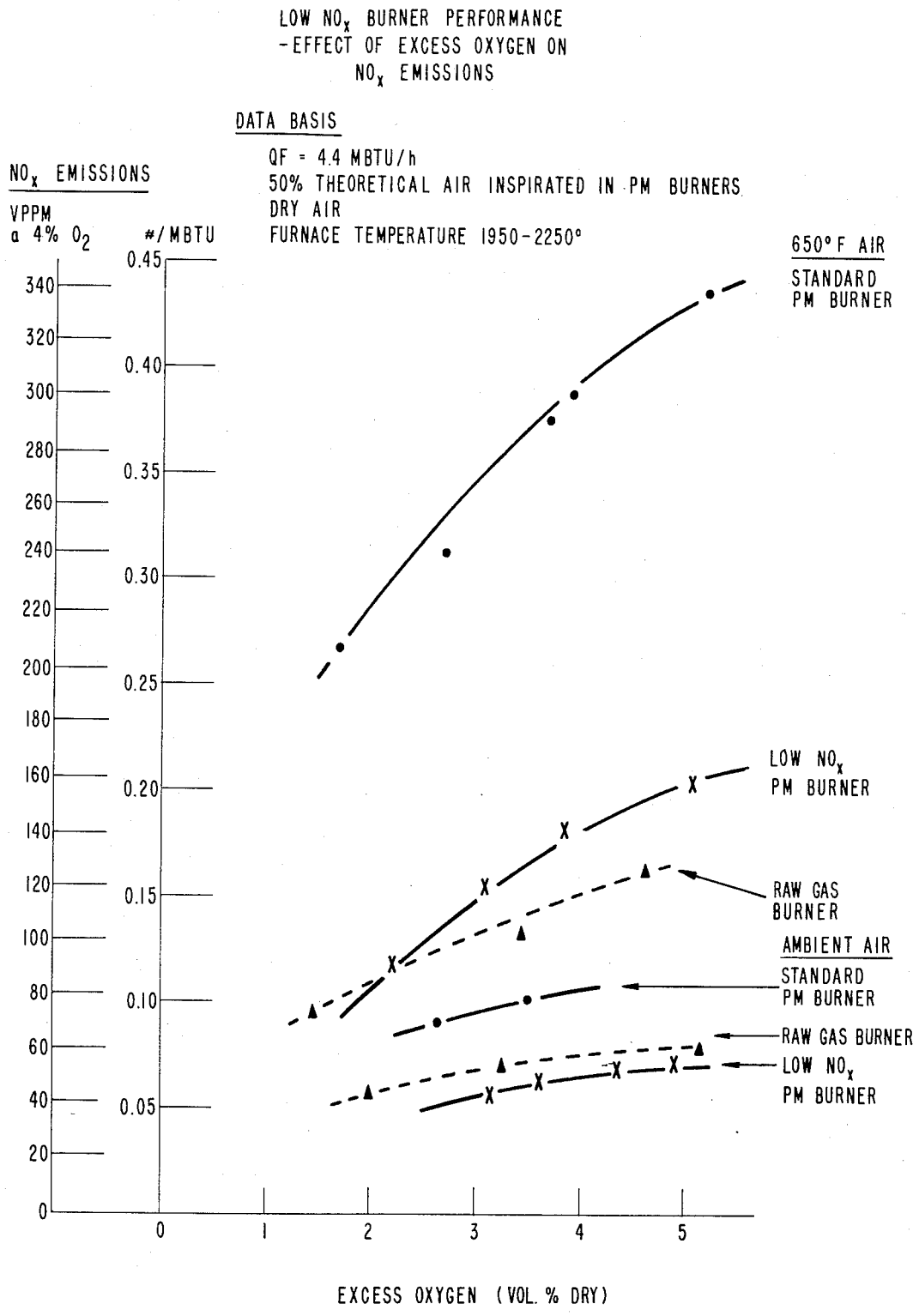
Figure 6:
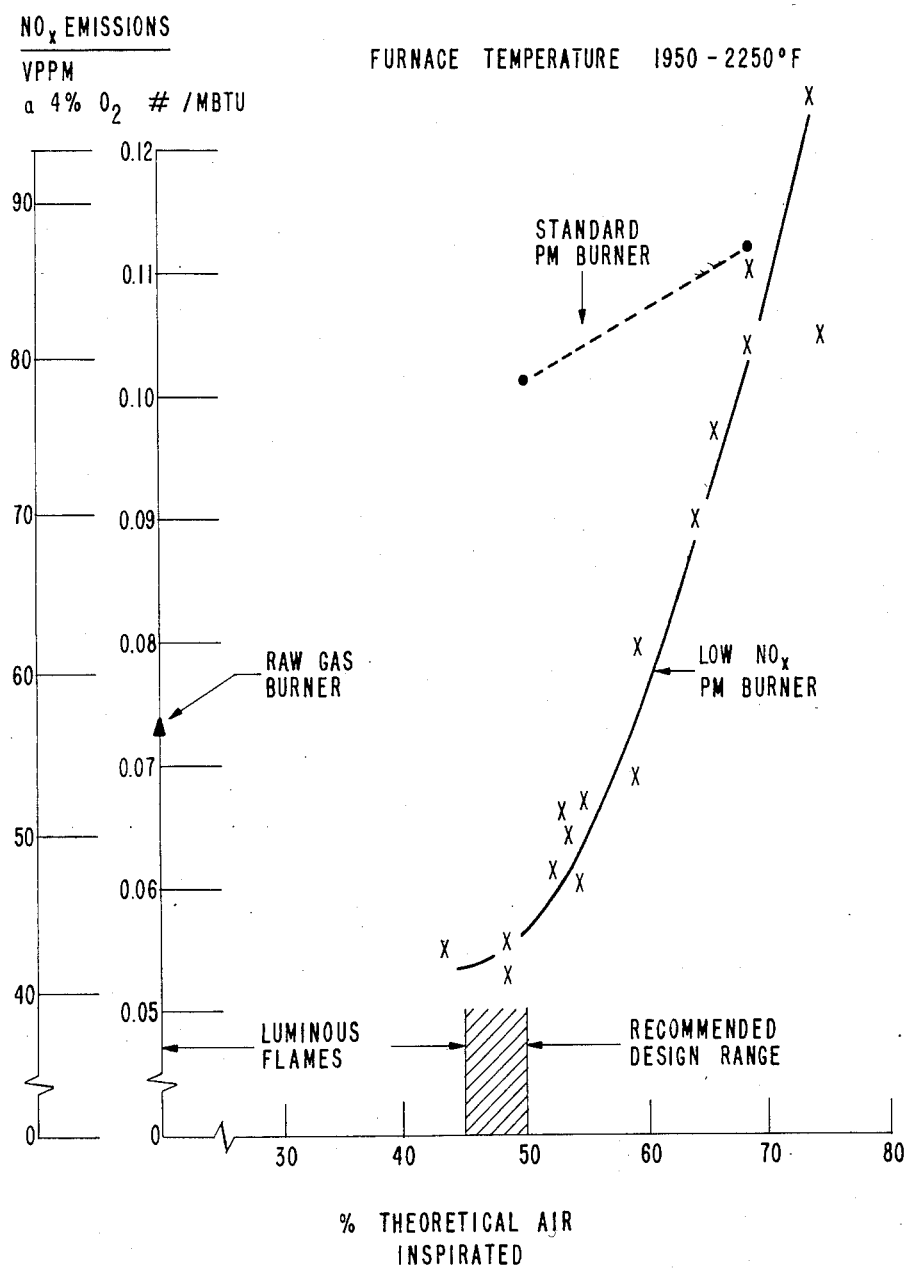

In FIGS. 4, 5 and 6 the burner as illustrated in FIG. 2 was compared with the standard PM burner and with a commercial raw gas burner characterized by staged fuel, not staged air, which was selected for evaluation since it was known to give excellent $NO_x$ reduction. However, the low $NO_x$ PM burner of this invention gave better results, viz., as low as 50 volume parts per million $NO_x$ at high furnace temperatures in excess of 2000° F.

It should be noted that the temperature of the flue gas in the furnace is important—if the temperature is lower it will cool off the flame more rapidly but if the temperature is higher it will do so more slowly. For instance, the burner of the invention emitted about 23 volume parts per million $NO_X$ when the furnace was at about 1700° F. Therefore, comparative tests have to be made, and were made, at the same furnace (flue gas) temperature conditions to obtain a valid comparison.

$NO_x$ Reduction Performance

Significant $NO_x$ reductions were achieved by the low $NO_x$ PM burner according to the invention on both ambient and preheated air when compared to the standard PM burner as shown in FIGS. 4, 5 and 6. Depending upon specific test conditions, reductions of 40 to 60% were achieved.

As shown in FIG. 4, $NO_x$ emissions were reduced by at least 40% on ambient air at the 3.5% excess $O_2$ level. At this $O_2$ level, percentage reductions on preheated air increased to over 50% at 650° F. (343° F.). With 400° F. (204° C.) air, $NO_x$ emissions from the low $NO_x$ PM burner were comparable to those from the standard burner operating on ambient air. In this connection it should be noted that, other things being equal, $NO_x$ increases with increasing air temperature. Also, it may be noted that the subject low $NO_x$ PM burner gave lower $NO_x$ than the raw gas burner at temperatures below 400° F. which constitutes an advantage since when preheated air is used commercially it is generally heated to temperatures less than 400° F.

As shown in FIG. 5, $NO_x$ emissions are sensitive to excess oxygen with minimum emissions generated at low excess air levels. With 650° F. and 2% excess oxygen, the low $NO_x$ PM burner achieved its best $NO_x$ reduction of slightly over 60% compared to the standard burner.

Although limited ambient air data was obtained for low excess air levels, based on the subject burner's performance with preheated air, $NO_x$ reduction performance for these levels is expected to be similar to or better than that achieved at high excess air levels. Therefore, at least a 40% $NO_x$ reduction for the subject burner as compared to the standard PM burner, is expected for the low excess air levels ($\leqq 2$ vol% $O_2$) at which most steam crackers are operated.

With regard to the raw gas burner, as shown in FIG. 5, its performance on ambient air was inferior to the low $NO_x$ PM burner. The staged fuel burner reduced $NO_x$ by only 25% (compared to 40% for the low $NO_x$ PM) over the reference standard PM burner. However, at very high preheat levels, $NO_x$ reductions comparable to or better than the low $NO_x$ PM burner were achieved as already noted, see FIGS. 4 and 5.

Primary air inspiration is a major factor in determining the $NO_x$ production of premix burners. As shown in FIG. 6, $NO_x$ emissions decrease as the primary air inspiration rate is decreased to about 50% of the theoretical air requirements. $NO_x$ emissions level out at inspiration rates between 40 to 50% of theoretical. Also, luminous flames are usually produced below about 40–45% air inspiration. Therefore, the low $NO_x$ PM burner should be designed to inspirate about 45–50% of the theoretical air requirement when the fuel to be used is natural gas or similar. For example, for a fuel consisting of 85 vol.% hydrogen and 15 vol.% natural gas, the burner should be designed to inspirate about 31–36% of the theoretical requirements. The design point for most gaseous fuels will lie between 31 and 50% of theoretical.

The low $NO_x$ PM burner was found to be particularly sensitive to primary air inspiration rates. In fact, FIG. 6 shows that $NO_x$ emissions of the low $NO_x$ PM and the standard PM burners are equivalent when primary air reaches about 70% of theoretical requirements.

Figure 7:
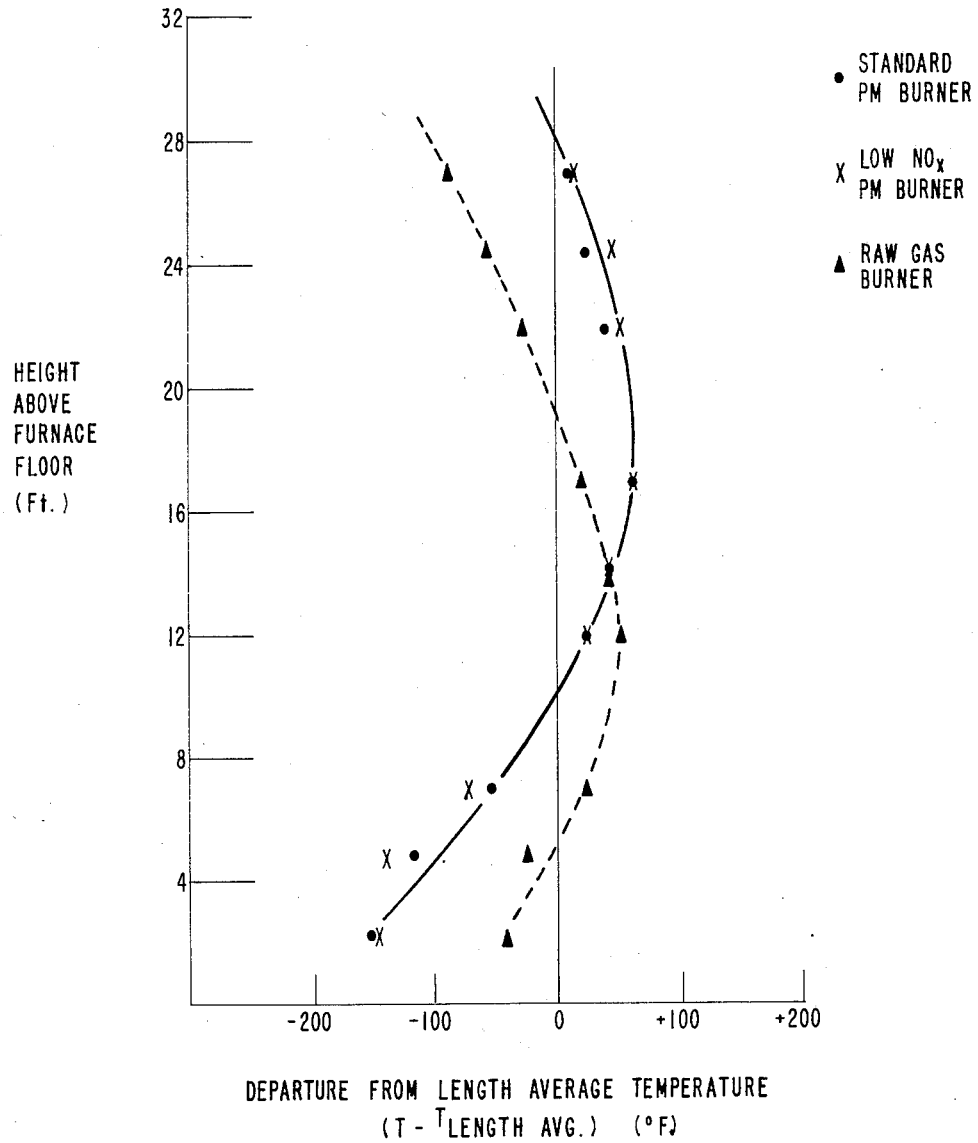

Over the range of test conditions, flame stability and heat distribution of the low $NO_x$ PM burner and the standard PM burner were almost identical. The wall refractory temperature profiles, which are an indication of the heat distribution, are almost identical as shown in FIG. 7. On the other hand, heat distribution for the raw gas burner is not as good as for the low $NO_x$ PM burner. As shown in FIG. 7, the raw gas burner releases heat lower in the furnace—in this connection it should be noted that pyrolysis tubes may be as tall as 30–40 feet, e.g., about 30 feet.

Other Configurations Tested

Limited testing of the effect of the secondary air port geometry was carried out by changing the height of the exit ports 16. Although extension of the height of these ports above the burner tile resulted in an additional 10% reduction in $NO_x$ emissions, the burner configuration with secondary air ports 16 terminating flush with the inner surface of the furnace floor 25, as shown, is preferred since it achieved excellent $NO_x$ reduction and is a more practical commercial burner due to its lower capital, operating and maintenance costs.

The following summarizes the improvement shown in the test data for the subject burner over the standard PM burner:

- Ambient Air Operation—$NO_x$ reductions of at least 40% were achieved.
- Preheated Air Operation—$NO_x$ reductions of up to 60% were achieved with preheated air temperatures as high as 650° F. (343° C.). At 400° F. (204° C.), $NO_x$ production was equivalent to the standard burner at ambient temperatures.
- Combustion Performance—Satisfactory combustion performance, including flame stability and heat distribution, was achieved and was equivalent to the standard burner.

The advantages that accrue from the improvement include the following:

- Retrofit into Existing Furnaces—The low $NO_x$ PM burner should be easy to retrofit into existing steam crackers by modifying installed PM burners, conveniently when the furnace is shut down. This will permit a more economic addition of air preheat without exceeding present $NO_x$ emission levels.
- Other $NO_x$ Control Technologies—The low $NO_x$ PM burner can be used along with other $NO_x$ control technologies, such as steam injection, to achieve even greater $NO_x$ reductions.
- Other Applications—This low $NO_x$ PM burner concept can be applied to gas turbine exhaust systems, as well as to other types of premix burners.

Thus it can be seen that, without sacrificing the chief desirable characteristics of the standard PM burner such as flame stability, non-luminous flames and good heat distribution and correspondingly without changing its essential character of being a premix burner, it is nevertheless possible by means of the modification of the present invention to obtain sharply reduced $NO_x$ production.

What is claimed is:

1. A premixing burner for the combustion of fuel gas and air with reduced $NO_x$ production, said burner having a primary air-fuel gas combustion assembly and a secondary air combustion assembly, the primary air-fuel gas combustion assembly comprising a burner tube and a burner tile spaced from and surrounding the downstream end of said tube, the burner tube having a mixer connected to an extension tube and a burner tip mounted on the downstream end of said extension tube, the said mixer having inlets for fuel gas and primary air and adapted to mix said fuel and primary air prior to combustion at predetermined ratios, said burner tip having ports for passage of the gas from the extension tube, the burner tube and burner tile being adapted to support and stabilize a substoichiometric initial flame resulting from the combustion of the gases passing through the burner tip, said initial flame having a base in the region formed by said burner tile and burner tip, said secondary air combustion assembly comprising multiple secondary air ports and secondary air inlet means therefor, said secondary air ports being spaced radially from said burner tile and circumferentially from each other, the radial spacing being a sufficient distance to permit secondary air streams from the ports to react with the flame of the premixed gas substantially downstream of the burner tip, the circumferential spacing between ports being a sufficient distance to permit furnace flue gas to re-circulate to the base of the initial flame in amounts at least sufficient to achieve lower temperatures in the initial flame and to move the secondary air streams away from the initial flame, the primary air-fuel gas ratios including the range of about 25–65% of the stoichiometric air requirement of the fuel gas, the burner being adapted for a total air requirement of up to about 120 mol % of the stoichiometric air requirement of the fuel gas.

2. The burner of claim 1 wherein the secondary air ports are substantially parallel to the burner tube.

3. The burner of claim 1 wherein the secondary air ports are equidistant from the center of the burner.

4. The burner of claim 1 wherein the secondary air ports terminate downstream of the burner tile.

5. The burner of claim 1 wherein a sealing plate is disposed upstream of the burner tip and across the space between the burner tile and burner tube.

6. The burner of claim 1 wherein the secondary air inlet means includes a plenum surrounding said burner tile and air flow control device for said plenum.

7. The burner of claim 1 wherein said mixer is in the form of a jet eductor for inspirating and mixing primary air and fuel gas.

8. The burner of claim 1 wherein the jet eductor includes an inlet pipe for fuel gas at high pressure, an orifice on said pipe to provide one or more jets of fuel gas and a venturi pipe to receive said fuel gas and inspirate air therewith.

9. A furnace having walls, a top and a floor and containing at least one premixing burner for the combustion of fuel gas and air with reduced $NO_x$ production, said burner having a primary air-fuel gas combustion assembly and a secondary air combustion assembly, the primary air-fuel gas combustion assembly comprising a burner tube and a burner tile spaced from and surrounding the downstream end of said tube, the burner tube having a mixer connected to an extension tube and a burner tip mounted on the downstream end of said extension tube, the said mixer having inlets for fuel gas and primary air and adapted to mix said fuel gas and primary air prior to combustion at predetermined ratios, said burner tip having ports for passage of the gas from the extension tube, the burner tube and burner tile being adapted to support and stabilize a substoichiometric initial flame resulting from the combustion of the gases passing through the burner tip, said initial flame having a base in the region formed by said burner tile and burner tip, said secondary air combustion assembly comprising multiple secondary air ports and secondary air inlet means therefor, said secondary air ports being spaced radially from said burner tile and circumferentially from each other, the radial spacing being a sufficient distance to permit secondary air streams from the ports to react with the flame of the premixed gas substantially downstream of the burner tip, the circumferential spacing between ports being a sufficient distance to permit furnace flue gas to re-circulate to the base of the initial flame in amounts at least sufficient to achieve lower temperatures in the initial flame and to move the secondary air streams away from the initial flame, the primary air-fuel gas ratios including the range of about 25–65% of the stoichiometric air requirement of the fuel gas, the burner being adapted for a total air requirement of up to about 120 mol% of the stoichiometric air requirement of the fuel gas.

10. The furnace of claim 9 in which at least one of said premixing burner is located in the floor of said furnace.

11. The furnace of claim 9 in which at least one of said premixing burner is located in the walls of said furnace.

12. The furnace of claims 9, 10 and 11 wherein the furnace includes coils adapted for steam cracking of olefins and said coils are disposed from top to floor of said furnace.

13. In a method for heating a furnace by combustion of fuel gas and air at ratios of upto about 120 mol% of stoichiometric air requirement, the improvement comprising conducting said combustion in spaced sequential steps while reducing the production of $NO_x$ in said combustion, said stages being:

(a) A premixed primary air-fuel gas combustion stage wherein primary air is added to fuel gas at ratios of about 25 to 65% of stoichiometric air requirement, the same are mixed to form a homogeneous gas mixture, the mixture is passed through a burner tube and then combusted to form an initial flame that is stabilized and supported by the burner tube and a burner tile surrounding the burner tube and furnace flue gas is recirculated to the base of the initial flame, (b) A secondary air combustion stage wherein secondary air is separated into individual air streams, the streams of secondary air flow to the initial flame at a position substantially downsteam of the base of the initial flame while furnace flue gas recirculates between the streams to the base of the initial flame and the secondary air reacts with the fuel gas remaining in the initial flame to complete the combustion thereof, the volume of furnace flue gas recirculating to the base of the initial flame during said stages being sufficient to lower the flame temperature of the initial flame and to maintain the secondary air streams away from the premixed primary air-fuel gas combustion stage.

14. The method of claim 13 in which the air for the primary air and the secondary air is selected from the group consisting of ambient air, preheated air and gas turbine exhaust.

15. The method of claim 13 wherein the ratio of primary air to fuel gas is at about the fuel-rich, upper limit of flammability.

16. The method of claim 13 wherin the fuel gas comprises natural gas and the ratio of primary air to fuel gas is about 45% to about 50% of the stoichiometric air requirement.

17. The method according to claim 13 wherein the furnace is a steam cracking furnace.

* * * * *